US006726004B2

(12) United States Patent
Watson

(10) Patent No.: US 6,726,004 B2
(45) Date of Patent: Apr. 27, 2004

(54) CASE FOR MULTIPLE PAIRS OF EYEGLASSES

(76) Inventor: Joe Watson, 5108 Thomas Ave. South, Minneapolis, MN (US) 55410

( * ) Notice: Subject to any disclaimer, the term of this patent is extended or adjusted under 35 U.S.C. 154(b) by 0 days.

(21) Appl. No.: 10/103,461

(22) Filed: Mar. 20, 2002

(65) Prior Publication Data

US 2003/0178324 A1 Sep. 25, 2003

(51) Int. Cl.[7] ..... A45C 11/04

(52) U.S. Cl. ..... 206/6; 206/45.23; 220/4.22; 220/830

(58) Field of Search ..... 206/5, 16, 45.2, 206/749, 752, 45.23; 220/4.21–4.23, 260, 264, 529, 531, 827–832

(56) References Cited

U.S. PATENT DOCUMENTS

| | | | | | |
|---|---|---|---|---|---|
| 683,417 | A | | 9/1901 | Weinstein | |
| 1,004,474 | A | | 9/1911 | Schnorr | |
| 1,649,255 | A | | 11/1927 | Robinson | |
| 2,807,355 | A | * | 9/1957 | Shiffman | 206/45.2 |
| 2,809,766 | A | | 10/1957 | Anderson | |
| 3,144,127 | A | | 8/1964 | Fogel | |
| 3,323,638 | A | | 6/1967 | Dishart | |
| 3,360,116 | A | | 12/1967 | Somers et al. | |
| D264,976 | S | | 6/1982 | Greene | |
| 4,369,883 | A | * | 1/1983 | Stravitz | 220/4.21 |
| 4,986,415 | A | * | 1/1991 | Posso | 206/45.2 |
| 5,033,634 | A | | 7/1991 | Batchelor et al. | |
| 5,100,006 | A | | 3/1992 | Forrester | |
| D333,037 | S | | 2/1993 | Dweck et al. | |
| D371,679 | S | | 7/1996 | Nejman | |
| 5,676,242 | A | | 10/1997 | Scott | |
| 6,026,950 | A | | 2/2000 | Wisniewski | |
| D433,230 | S | | 11/2000 | Ellis | |
| 6,234,313 | B1 | * | 5/2001 | Slevin | 206/45.2 |
| 6,296,142 | B1 | * | 10/2001 | Nguyen | 220/830 |
| 6,364,100 | B1 | * | 4/2002 | Leibeck | 206/45.2 |

* cited by examiner

*Primary Examiner*—Luan K. Bui
(74) *Attorney, Agent, or Firm*—Patterson, Thuente, Skaar & Christensen, P.A.

(57) ABSTRACT

A case for multiple pairs of eyeglasses has a top surface and an opposing bottom surface, a front surface and an opposing back surface and defines a volume for receiving eyeglasses with a length orientation of the eyeglasses substantially parallel to the front of the case. The case is formed from a cover portion and a base portion, hinged together at a pivot line that extends across the bottom of the case parallel to the length orientation of a pair of eyeglasses stored in the case. Preferably, the pivot line is offset on the bottom of the case so as to be closer to the back than the front. The pivot line forms a part of a mating line between the cover portion and the base portion. Preferably, the mating line extends obliquely upward from the bottom, across the ends of the case, and across the top. A divider separates the internal volume of the case into two compartments, each accommodating one pair of eyeglasses. The compartments are offset obliquely, allowing the top-to-bottom dimension of the case to be minimized for easier, more convenient carrying in a jacket or shirt pocket, while still allowing the use of rigid material, providing better protection for the eyeglasses than can be provided in a soft-sided case.

33 Claims, 5 Drawing Sheets

100

170
122
112
102
124
102
110
108
154
152
160
126
104
114
106
150
120
128

CASE FOR MULTIPLE PAIRS OF EYEGLASSES

FIELD OF THE INVENTION

This invention relates to cases for eyeglasses. More specifically, it relates to cases for multiple pairs of eyeglasses.

BACKGROUND OF THE INVENTION

In recent years, with the general aging of the population, the need for eyeglasses to correct vision defects in people has increased. Research in vision diagnosis and treatment has also indicated that it is sometimes desirable to wear different eyeglasses based on the purpose and situation in which they are to be used. For example, it is now common that separate eyeglasses intended especially for use in viewing a computer screen are prescribed for some individuals, in addition to other pairs of eyeglasses used for other purposes such as driving or reading. Prescription sunglasses, non-prescription sunglasses for use over contact lenses and special prescriptions for use in hobbies and recreational activities all may be employed. The result has been that more persons are wearing multiple pairs of eyeglasses.

Since only one pair of eyeglasses may generally be worn at one time, a user must typically carry the other pairs along wherever they may be needed. Lighter weight glasses are desirable from both a comfort and a style standpoint. Due to the need to make eyeglasses lightweight, the frames of the glasses are often somewhat delicate and may be easily bent or broken. Optimal vision correction performance is not achieved if the lenses are misaligned through bending of the frames. In addition, eyeglasses can have precision optic lenses that degrade in performance if scratched. In particular, antireflective coatings and other high performance coatings tend to be soft and easily damaged through abrasion and exposure to dirt and the like. Further, when glasses are folded, the ends of temples tend to contact the backside of the prescription lenses and scratch them at the point of contact. As a result, it is desirable to protect eyeglasses in some form of case when they are not being worn.

The increase in the number of eyeglass pairs owned by individuals, coupled with the need to protect those glasses has resulted in an increased need for a convenient protective case that is easily carried, and that will hold more than one pair of eyeglasses.

Early attempts at creating a case for multiple pairs of eyeglasses are disclosed in U.S. Pat. No. 683,417 to Weinstein and U.S. Pat. No. 1,004,474 to Schnorr. At the time these cases were invented, however, eyeglasses were often of the pince-nez design that rested on the nose and had no temples extending over the ears of the wearer as commonly used in the eyeglass designs of today. Because these cases were designed to hold two pairs of relatively thin pince-nez glasses stacked directly on top of each other, the overall thickness of the case was not excessive. If such a directly stacked hard-sided design were to be used for eyeglasses having temples, however, the result would be an unsuitably thick and bulky case that was difficult to carry in a shirt or jacket pocket.

Another more recent example of a case for multiple pairs of eyeglasses is disclosed in U.S. Pat. No. 5,676,242 to Scott. The case has compartments for two pairs of glasses, one in a hard-sided compartment and one in an attached soft-sided compartment on top of the hard-sided compartment. This case, however, has a number of disadvantages. First, the soft-sided compartment provides lessened crush protection and possibly inadequate protection for the eyeglasses stored in this compartment. Secondly, snaps and zippers are used to secure the compartments, which can be difficult to manipulate, and cannot be opened with only one hand. Such fasteners may tend to abrade frames or lenses when the glasses are slid into the compartment. Finally, the case has projections, such as the snap secured pocket on one surface and the pocket clip on the opposing surface that make the case unstable when laid on a flat surface, particularly when one or more of the compartments are open.

While existing cases for multiple pairs of eyeglasses have been developed, there remains a need for an eyeglass case that will more effectively accommodate more than one pair of eyeglasses.

SUMMARY OF THE INVENTION

The present invention provides a case for multiple pairs of eyeglasses. The case has a top surface and an opposing bottom surface, a front surface and an opposing back surface and defines a volume for receiving eyeglasses with a length orientation of the eyeglasses substantially parallel to the front of the case. The case is formed from a cover portion and a base portion, hinged together at a pivot line that extends across the bottom of the case parallel to the length orientation of a pair of eyeglasses stored in the case. Preferably, the pivot line is offset on the bottom of the case so as to be closer to the back than the front. The pivot line forms a part of a mating line between the cover portion and the base portion. Preferably, the mating line extends obliquely upward from the bottom, across the ends of the case, and across the top. A divider separates the internal volume of the case into two compartments, each accommodating one pair of eyeglasses. The compartments are offset obliquely, allowing the top-to-bottom dimension of the case to be minimized for easier, more convenient carrying in a jacket or shirt pocket, while still allowing the use of rigid material, providing better protection for the eyeglasses than can be provided in a soft-sided case.

In a preferred embodiment, the hinged connection between the cover portion and the base portion may be provided with a spring for urging the cover and base into a closed position or an open position or both. In addition, detent stops may be provided whereby the case is held in an open or closed position or both. The divider also may be provided with a spring and may be coordinated with the cover and base, so that when the case is opened, the divider assumes a position intermediate of the cover portion and the base portion. The case may also be provided with a latching mechanism for securing the case in a closed position.

The location of the pivot line on the bottom of the case provides a unique advantage, in that when the case is opened, the bottom is articulated into an angled surface. The case can then be placed on any flat surface when opened, and the angled bottom provides a stable base to counterbalance the case from tipping over when opened. The articulation of the case bottom also allows easier, one-handed operation of the case by a user.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE PREFERRED EMBODIMENTS

Figure 1:
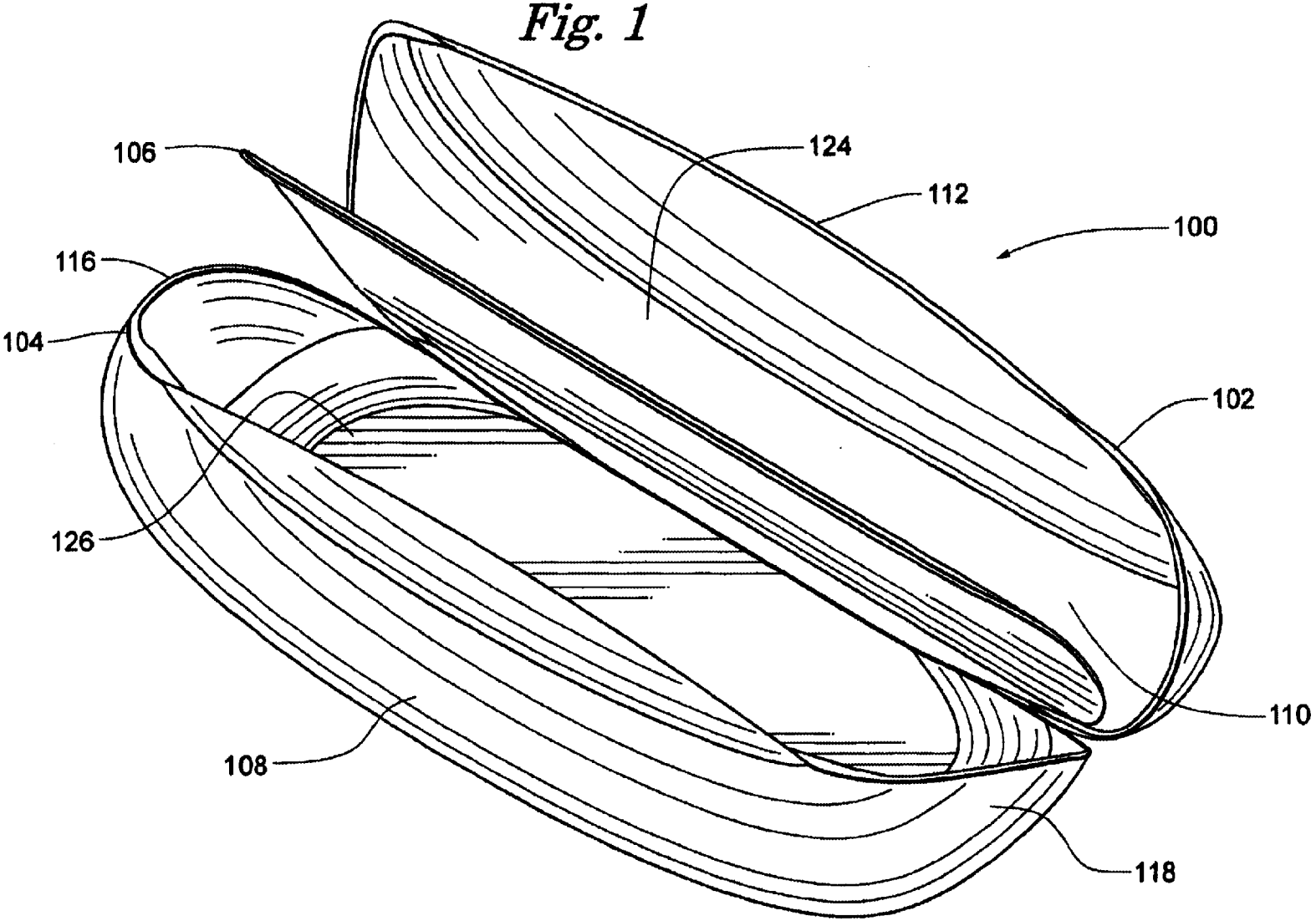
FIG. 1 is a perspective view of a preferred embodiment of the eyeglass case of the present invention.

In FIG. 1, there is shown generally a currently most preferred embodiment of the eyeglass case 100 of the present invention. Case 100 is configured as a rigid, elongate box formed from cover portion 102 and base portion 104, and has front 108, back 110, top 112, bottom 114 and a pair of opposing ends 116 and 118. Cover portion 102 and base portion 104 may be made from any suitable material, with the currently preferred materials being metal or rigid plastic preferably covered with a leather or synthetic material. Divider 106 separates the internal volume of case 100 into two compartments 124 and 126 for eyeglasses. Those of skill in the art will recognize that the volume necessary for each compartment 124 and 126 is determined by the length, width and depth orientations of a folded pair of eyeglasses. The length orientation of a pair of eyeglasses is the long dimension across both lenses when the eyeglasses are folded. The width orientation is the dimension perpendicular to the length orientation in a plane formed by the lenses. The depth orientation of a pair of eyeglasses is the dimension orthogonal to the plane formed by the lenses and is the thickness of the pair of eyeglasses when folded. Case 100, and each compartment 124 and 126, must accommodate the length orientation of a pair of eyeglasses substantially parallel to front 108, and must also accommodate the corresponding width and depth orientation of the pair of eyeglasses.

Figure 2:
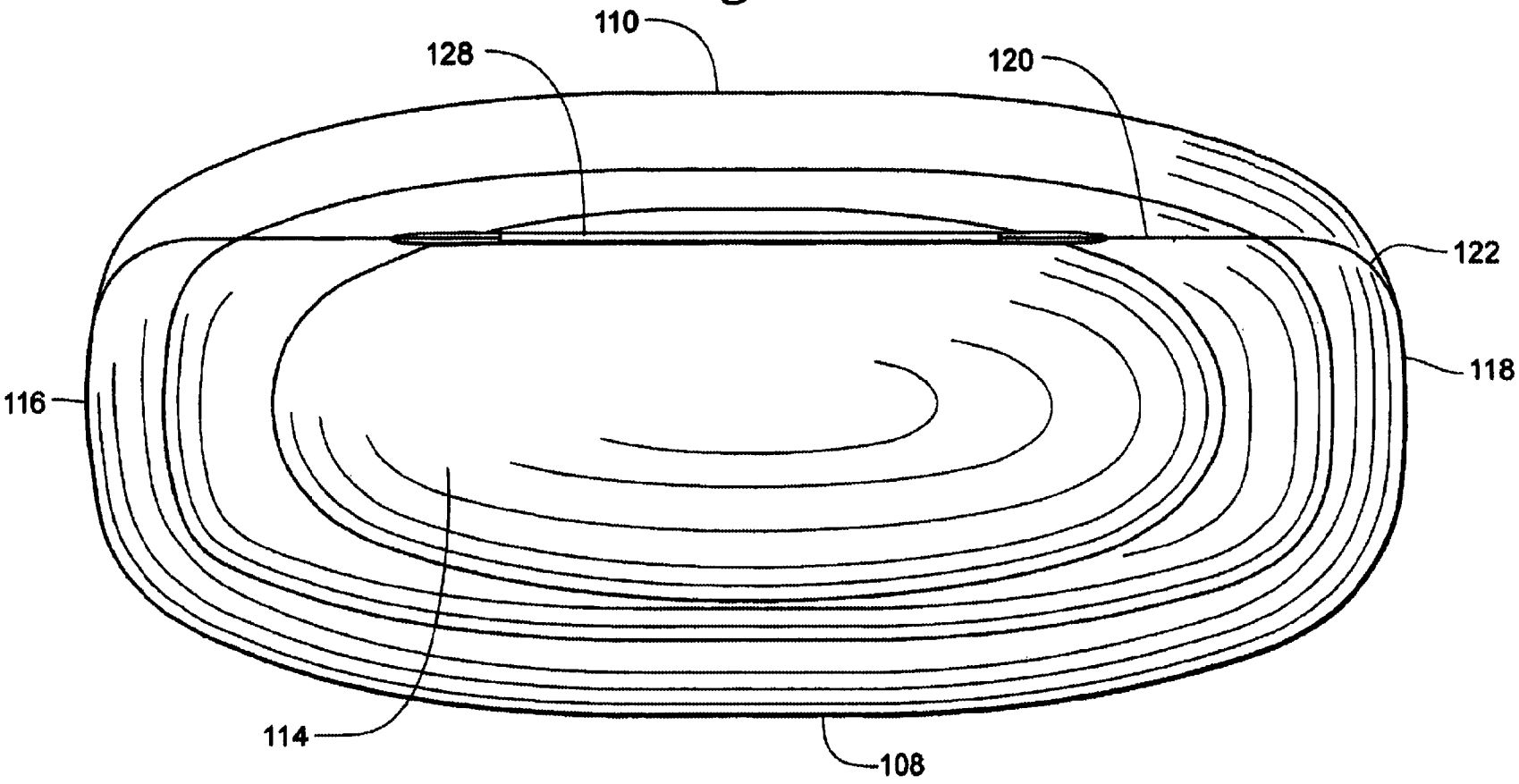
FIG. 2 is a bottom view of the case.
Figure 3:
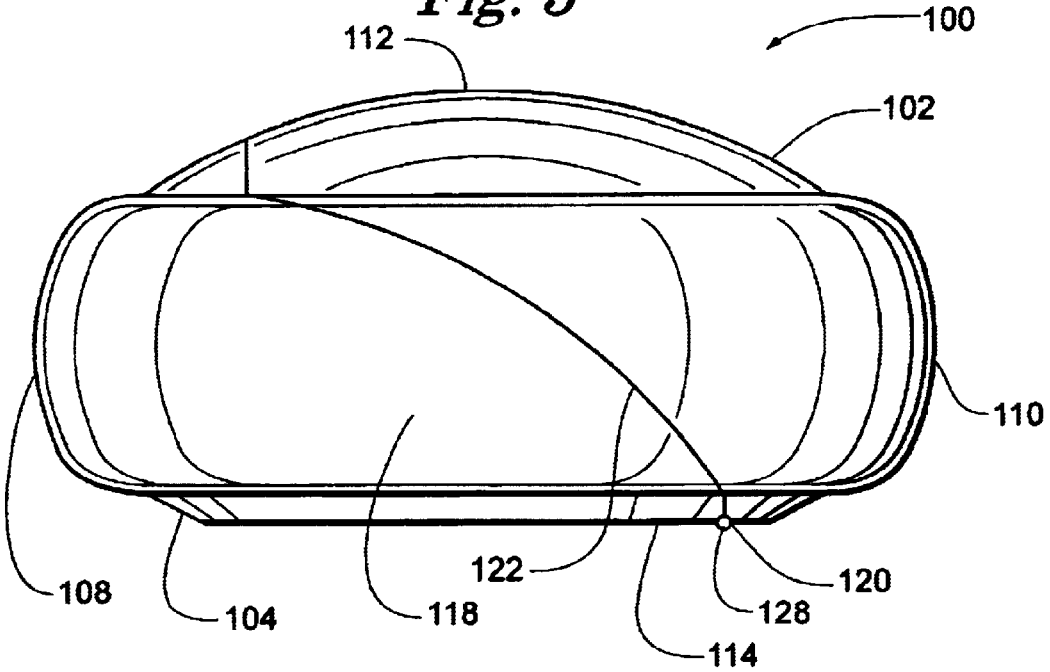
FIG. 3 is an end elevation of the case.
Figure 4:
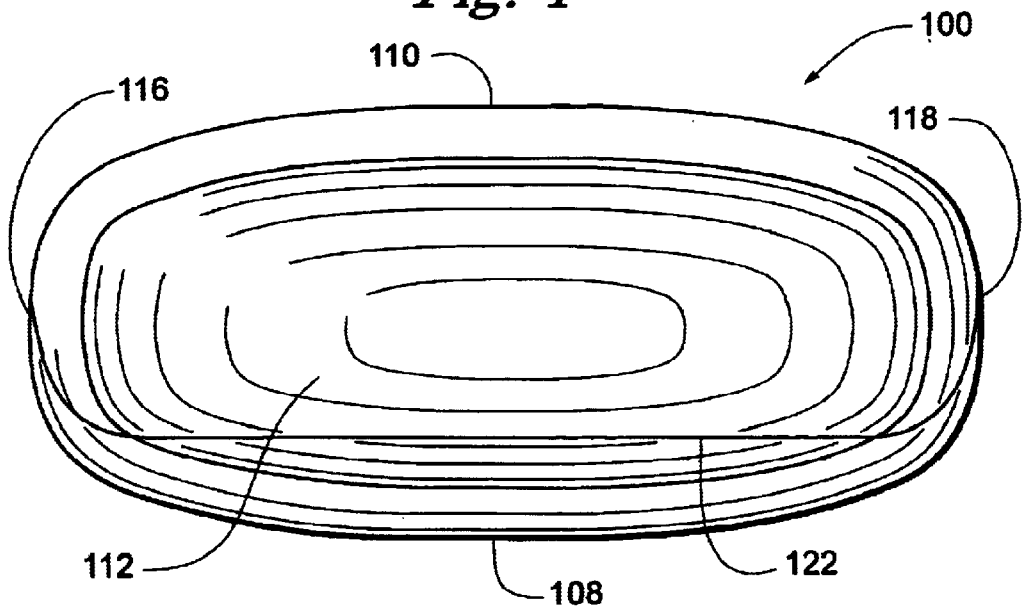
FIG. 4 is a top view of the case.

The unique articulation of case 100 is shown in FIGS. 2–4. Referring first to FIG. 2, which is a view from the bottom of case 100, cover portion 102 and base portion 104 are hinged together along pivot line 120 on bottom 114. The hinged attachment between cover portion 102 and base portion 104 may be accomplished with a single lateral hinge 128 as shown, but may also be accomplished with any other type of hinged attachment, including multiple hinges or scored material. Pivot line 120 is substantially parallel with the length orientation of a pair of eyeglasses when stored in case 100. Pivot line 120 preferably is closer to back 110 than front 108, and the area of bottom 114 between pivot line 120 and back 110 is smaller than the area of bottom 114 between pivot line 120 and front 108. Pivot line 120 forms a part of mating line 122. Mating line 122 is the line where cover portion 102 and base portion 104 are mated together to form case 100.

As shown in FIGS. 3 and 4, mating line 122 extends upward obliquely from bottom 114 across each of ends 116 and 118 and across top 112. Across top 112, mating line 122 is parallel with the length orientation of a pair of eyeglasses when they are stored in case 100. Mating line 122 is closer to front 108 than back 110, and the area of top 112 between mating line 122 and front 108 is smaller than the area of top 112 between mating line 122 and back 110.

Figure 5:
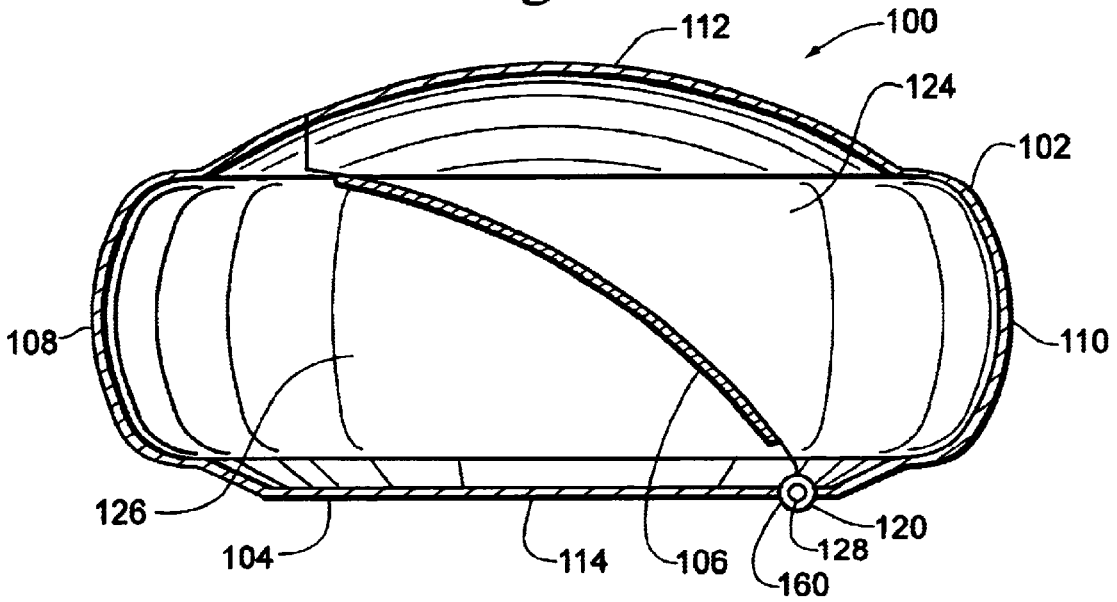
FIG. 5 is a cross-sectional view of the case in a closed position.
Figure 6:
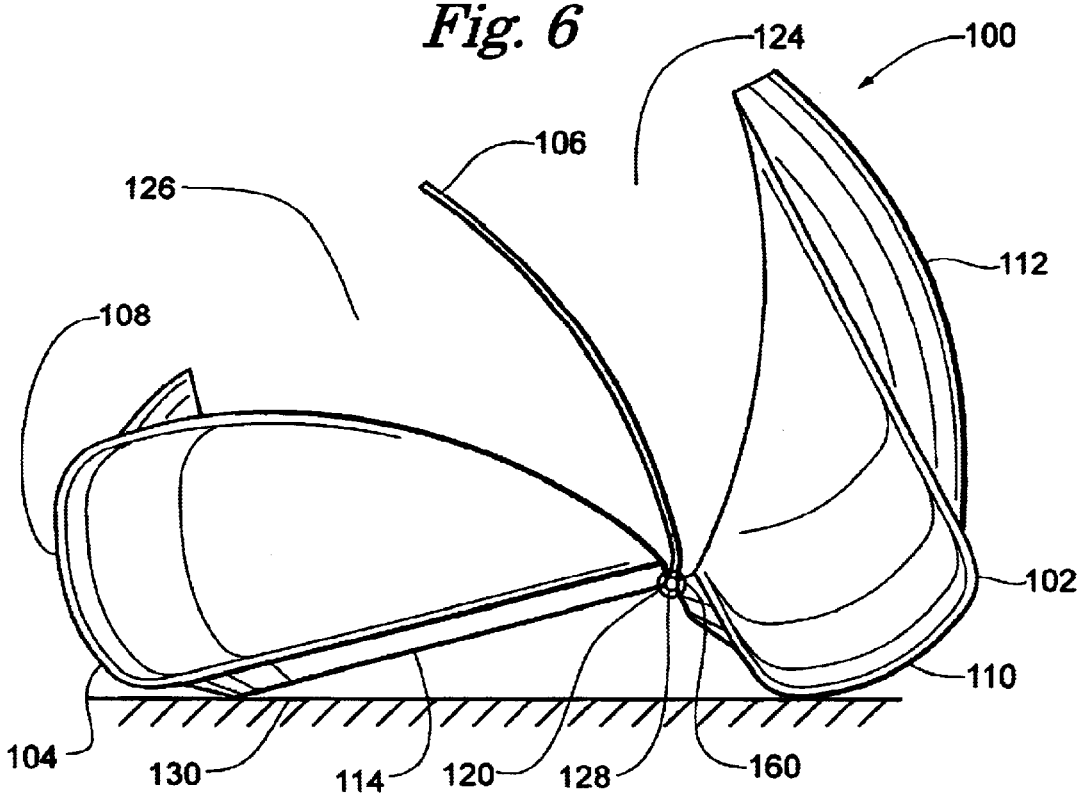
FIG. 6 is an end elevation of the case in an open position.

Referring now to FIGS. 5 and 6, the operation of the invention can be understood. When case 100 is closed and cover portion 102 and base portion 104 are mated at mating line 122, divider 106 separates case 100 into two compartments 124 and 126, wherein a pair of folded eyeglasses may be stored. The offset orientation of compartments 124 and 126 allows the depth orientation of two pairs of eyeglasses to be accommodated while minimizing the distance between bottom 114 and top 112. Thus, case 100 has a relatively lower profile, making it easier to fit into a jacket or shirt pocket, while retaining the protective advantages of a rigid, hard-sided case. When case 100 is opened, as shown in FIG. 6, compartments 124 and 126 may be accessed to remove the eyeglasses. Divider 106 may be attached to case 100 at pivot line 120 as shown or at any other point within case 100, and may be provided with a spring and coordinated with cover portion 102 and base portion 104 so that when case 100 is opened, divider 106 moves to a position intermediate of cover portion 102 and base portion 104 to allow better access to the eyeglasses in each of compartments 124 and 126.

Those of skill in the art will recognize that hinge 128 may be provided with a spring 160 to bias cover portion 102 and base portion 104 toward either or both an open position and a closed position, and further may be provided with detents at either or both of those positions. In the opened position as shown in FIG. 6, case may be placed on a flat surface 130. The offset location of pivot line 120 on bottom 114 allows back 110 to contact flat surface 130, propping bottom 114 at an angle with respect to flat surface 130. In this position, bottom 114 is articulated into an angled surface, providing a more stable base than a flat bottom to counterbalance case 100 from tipping over when open.

In addition, the configuration of case 100 is particularly advantageous for operation with one hand. If bottom 114 is placed in the palm of the user's hand with pivot line 120 at the base of the fingers, the user's fingers may be wrapped around back 110 and over top 112, which is accommodatingly curved. The thumb may be placed on front 108, and by movement of the fingers, the case may be opened and closed with one hand.

Figure 7:
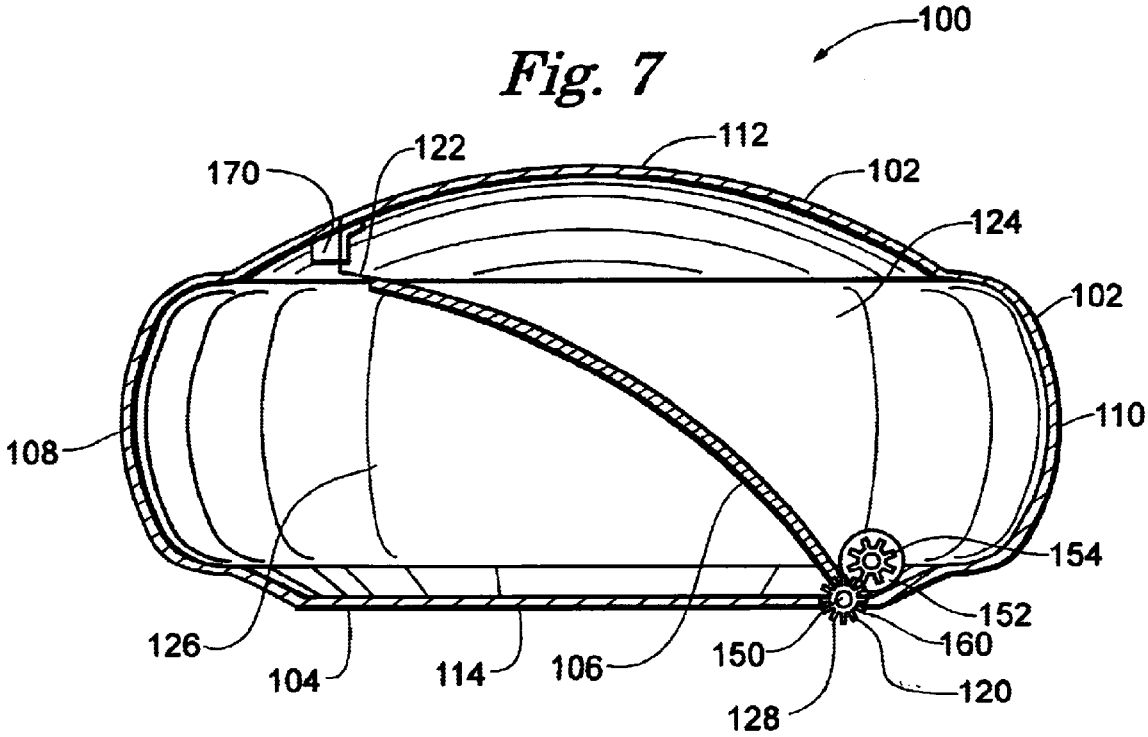
FIG. 7 is a cross-sectional view of a preferred embodiment of the case in a closed position.

In another preferred embodiment shown in FIG. 7, pinion 150 is fixed to the portion of hinge 128 that is rotationally fixed with respect to base portion 104. Dampener mechanism 152 is fixed to cover portion 102, and has gear 154 enmeshed with pinion 150. In operation, when spring 160 urges cover portion 102 toward the open position for case 100, dampener mechanism 152 acts to retard the relative motion of cover portion 102 and base portion 104, thereby providing a smooth opening motion for case 100. Although a pinion arrangement is described, dampener mechanism 152 may be any standard miniature dampener mechanism of pinion, or camming operation or the like, such as for example, those manufactured by NIFCO, Inc. of Japan.

Those of skill in the art will appreciate that case 100 can be provided with a latch so that the case may be securely fastened in a closed position. The latch may be of any type and may be located in any effective location. Currently it is most preferred that the latch be magnetic, and be operable.

Referring again to FIG. 7, magnetic latch 170 is of the push-latch type and is provided along mating line 122 in top 112. Those of skill in the art will recognize that a particularly advantageous mode of operation for case 100 may be achieved when case 100 is closed and placed with bottom 114 resting on a flat surface. In that position, cover portion 102 may be lightly pressed downward toward base portion

104 releasing magnetic latch 170. Spring 160 urges cover portion 102 upward, opening case 100. Dampener mechanism 152 provides a retarding force, resisting the bias of the spring, and causing case 100 to smoothly open to the stable open position as described above, and shown in FIG. 6.

Although the description above contains many specificities, these should not be construed as limiting the scope of the invention but as merely providing illustrations of some of the presently preferred embodiments of the invention. Thus, the scope of the invention should be determined by the appended claims and their legal equivalents, rather than by the examples given.

What is claimed:

1. A case for multiple pairs of eyeglasses comprising:

an elongate box having at least a top surface and an opposing bottom surface, a front surface and an opposing back surface and defining a volume adapted to receive at least two pair of eyeglasses with a length orientation of said pairs of eyeglasses substantially parallel to said front surface and with a width orientation of said pairs of eyeglasses substantially perpendicular to said front surface;

said box being formed by a base portion and a cover portion operably hinged together at a pivot line that extends across said bottom surface substantially parallel to said length orientation of said pairs of eyeglasses, said pivot line defining at least part of a mating line between said base portion and said cover portion; and a divider pivotally connected to an interior portion of said box along an edge substantially parallel to said length orientation of said pairs of eyeglasses;

such that said case defines at least two separate compartments, each compartment adapted to receive a separate pair of eyeglasses.

2. The case of claim 1, wherein said divider includes at least one spring member operably arranged along said edge to bias said divider to a position intermediate said two separate compartments when said cover portion is opened from said base portion.

3. The case of claim 1, wherein said pivot line is offset an unequal distance between said front surface and said back surface such that a first portion of said bottom surface defined between said pivot line and said front surface is greater than a second portion of said bottom surface defined between said mating line and said back surface.

4. The case of claim 1, wherein said bottom surface forms an angled surface that provides a stable base to counterbalance said case from tipping over when said cover portion is opened form said base portion.

5. The case of claim 1, wherein said elongate box further includes a pair of opposing ends and wherein said mating line extends upward obliquely across each of said opposing ends.

6. The case of claim 1, wherein said cover portion has an open position and a closed position and said pivot line further comprises at least one spring member operably arranged along said pivot line to bias said cover position to at least one of said open position and said closed position.

7. The case of claim 6, wherein said spring has a detent corresponding to the open position, whereby the case is held in the open position by the detent.

8. The case of claim 6, further comprising a dampener mechanism disposed so as provide a retarding force opposing the bias of said spring member.

9. The case of claim 1, further comprising a latch mechanism operably arranged between said base portion and said cover portion proximate said mating line to releasably latch said cover portion to said base portion.

10. The case of claim 9, wherein said latch mechanism includes a magnet.

11. The case of claim 9, wherein said latch mechanism is a push-latch.

12. The case of claim 1, wherein said case includes two separate compartments and each compartment is oriented obliquely relative to said front surface and said back surface such that a depth of said case is less than a depth corresponding to two pair of eyeglasses stacked horizontally on each other.

13. A case for multiple pair of eyeglasses comprising:

an elongate rigid box having at least a top surface and an opposing bottom surface, a front surface and an opposing back surface and defining a volume adapted to receive two pairs of eyeglasses with a length orientation of said pairs of eyeglasses substantially parallel to said front surface and with a width orientation of said pairs of eyeglasses substantially perpendicular to said front surface;

said box being formed by a base portion and a cover portion operably hinged together at a pivot line defining at least part of a mating line between said base portion and said cover portion;

an interior portion of said box defining two compartments, each compartment adapted to receive one of said two pairs of eyeglasses with said pairs of eyeglasses being oriented obliquely relative to said front surface and said back surface such that a depth of said case is less than a depth corresponding to two pair of eyeglasses stacked horizontally on each other; and a substantially planar divider pivotally connected to said interior portion of said box along an edge substantially parallel to said length orientation of said pairs of eyeglasses, such that at least one surface of each of said two compartments is defined by said planar divider when said case is closed.

14. The case of claim 13, wherein said divider includes at least one spring member operably arranged along said edge to bias said planar divider to a position intermediate said two separate compartments when said cover portion is opened from said base portion.

15. The case of claim 14, further comprising a dampener mechanism disposed so as provide a retarding force opposing the bias of said spring member.

16. A case for multiple pairs of eyeglasses comprising:

an elongate rigid box having at least a top surface and an opposing bottom surface, a front surface and an opposing back surface and defining a volume adapted to receive two pairs of eyeglasses with a length orientation of said pairs of eyeglasses substantially parallel to said front surface and with a width orientation of said pairs of eyeglasses substantially perpendicular to said front surface;

said box being formed by a base portion and a cover portion operably hinged together at a pivot line defining at least part of a mating line between said base portion and said cover portion, wherein said pivot line extends across said bottom surface substantially parallel to said length orientation of said pairs of eyeglasses and wherein said pivot line is offset an unequal distance between said front surface and said back surface such that a first portion of said bottom surface defined between said pivot line and said front surface is greater than a second portion of said bottom surface defined between said mating line and said back surface; and an interior portion of said box defining two compartments, each compartment adapted to receive one of said two pairs of eyeglasses with said pairs of eyeglasses being oriented obliquely relative to said front surface and said back surface such that a depth of said case is less than a depth corresponding to two pair of eyeglasses stacked horizontally on each other.

17. The case of claim 16, wherein said bottom surface forms an angled surface that provides a stable base to counterbalance said case from tipping over when said cover portion is opened from said base portion.

18. The case of claim 16, wherein said elongate box further includes a pair of opposing ends and wherein said mating line extends upward obliquely across each of said opposing ends.

19. The case of claim 16, wherein said cover portion has an open position and a closed position and said pivot lie further comprises at least one spring member operably arranged along said pivot line to bias said cover position to at least one of said open position and said closed position.

20. The case of claim 16, further comprising a latch mechanism operably arranged between said base portion and said cover portion proximate said mating line to releasably latch said cover portion to said base portion.

21. The case of claim 20, wherein said latch mechanism is a push-latch.

22. The case of claim 16, further comprising a substantially planar divider pivotally connected to said interior portion of said box along an edge substantially parallel to said length orientation of said pairs of eyeglasses, such that at least one surface of each of said two compartments is defined by said planar divider when said case is closed.

23. The case of claim 22, wherein said divider includes at least one spring member operably arranged along said edge to bias said planar divider to a position intermediate said two separate compartments when said cover portion is opened from said base portion.

24. The case of claim 23, further comprising a dampener mechanism disposed so as provide a retarding force opposing the bias of said spring member.

25. A case for at least one pair of eyeglasses comprising:

an elongate box having a top, a bottom, a front and a back formed by a base portion and a cover portion operably hinged together at a pivot line, said pivot line defining at least part of a mating line between said base portion and said cover portion;

means for dividing said case into at least two compartments, each adapted to receive a separate pair of eyeglasses, including a substantially planar divider pivotally connected to an interior portion of said box along an edge substantially parallel to said pivot line; and means for providing a stable base to counterbalance said case from tipping over when said cover portion is opened from said base portion and said bottom of said box is placed on a surface by articulating said bottom of said box to form an angled bottom when said cover portion is opened from said base portion.

26. The case of claim 25, wherein said angled bottom is formed by disposing said pivot line on said bottom of said box at an unequal distance between said front and said back such that a first portion of said angled bottom defined between said pivot line and said front surface is greater than a second portion of said angled bottom defined between said mating line and said back.

27. The case of claim 25, further comprising means for biasing said planar divider to a position intermediate said two separate compartments when said cover portion is opened from said base portion.

28. The case of claim 27, wherein said means for biasing said planar divider includes at least one spring member operably arranged along said edge.

29. The case of claim 25, wherein said cover portion has an open position and a closed position and further comprising means for biasing said cover position to at least one of said open position and said closed position.

30. The case of claim 29, further comprising dampener means for providing a retarding force opposing the bias of said biasing means.

31. The case of claim 29, wherein said means for biasing said cover position comprises at least one spring member operably arranged along said pivot line.

32. The case of claim 25, wherein said cover portion has an open position and a closed position and further comprising means for latching said case in said closed position.

33. The case of claim 32, wherein said means for latching comprises a latch mechanism operably arranged between said base portion and said cover portion proximate said mating line to releasably latch said cover portion to said base portion.

* * * * *